US009041627B2

(12) United States Patent
Uchino et al.

(10) Patent No.: US 9,041,627 B2
(45) **Date of Patent: *May 26, 2015**

(54) DISPLAY APPARATUS AND METHOD OF DRIVING SAME

(75) Inventors: Katsuhide Uchino, Kanagawa (JP); Yukihito Iida, Kanagawa (JP)

(73) Assignee: Sony Corporation, Tokyo (JP)

( * ) Notice: Subject to any disclaimer, the term of this patent is extended or adjusted under 35 U.S.C. 154(b) by 157 days.

This patent is subject to a terminal disclaimer.

(21) Appl. No.: 12/662,063

(22) Filed: Mar. 30, 2010

(65) Prior Publication Data

US 2010/0188384 A1 Jul. 29, 2010

Related U.S. Application Data

(63) Continuation of application No. 11/802,150, filed on May 21, 2007, now Pat. No. 7,768,485.

(30) Foreign Application Priority Data

May 22, 2006 (JP) ..... 2006-141836

(51) Int. Cl.
*G09G 3/30* (2006.01)
*G09G 3/32* (2006.01)

(52) U.S. Cl.
CPC ..... *G09G 3/3233* (2013.01); *G09G 2300/0819* (2013.01); *G09G 2300/0842* (2013.01); *G09G 2300/0866* (2013.01); *G09G 2320/043* (2013.01)

(58) Field of Classification Search
CPC . G09G 3/3233; G09G 3/3283; G09G 3/3291; G09G 2300/0819; G09G 2300/0866
USPC ..... 345/76–83; 315/169.3; 313/463, 504
See application file for complete search history.

(56) References Cited

U.S. PATENT DOCUMENTS 6,724,151 B2 4/2004 Yoo
2004/0174349 A1 9/2004 Libsch et al.

(Continued)

FOREIGN PATENT DOCUMENTS

CA 2 526 436 A1 2/2006
EP 1 465 141 10/2004

(Continued)

OTHER PUBLICATIONS

Japanese Office Action issued Mar. 16, 2010 for related Japanese Application No. 2008-200405.

(Continued)

*Primary Examiner* — Jimmy H Nguyen
(74) *Attorney, Agent, or Firm* — Fishman Stewart Yamaguchi PLLC

(57) ABSTRACT

A display apparatus including a pixel array and a driver configured to drive the pixel array, the pixel array having scanning lines as rows, signal lines as columns, a matrix of pixels disposed at respective intersections of the scanning lines and the signal lines, and power supply lines disposed along respective rows of the pixels, the driver having a main scanner for successively supplying control signals to the scanning lines to perform line-sequential scanning on the rows of the pixels, a power supply scanner for supplying a power supply voltage, which selectively switches between a first potential and a second potential, to the power supply lines in synchronism with the line-sequential scanning, and a signal selector for supplying a signal potential, which serves as a video signal, and a reference potential to the signal lines as the columns in synchronism with the line-sequential scanning.

10 Claims, 18 Drawing Sheets

(56) References Cited

U.S. PATENT DOCUMENTS

| | | | | |
|---|---|---|---|---|
| 2005/0105031 | A1 | 5/2005 | Shih et al. | |
| 2005/0206590 | A1 | 9/2005 | Sasaki et al. | |
| 2005/0269959 | A1 | 12/2005 | Uchino et al. | |
| 2005/0285825 | A1* | 12/2005 | Eom et al. | 345/76 |
| 2006/0176250 | A1 | 8/2006 | Nathan et al. | |

FOREIGN PATENT DOCUMENTS

| | | | |
|---|---|---|---|
| JP | 2003-255856 | A | 9/2003 |
| JP | 2003-255897 | A | 9/2003 |
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| JP | 2004-295131 | | 10/2004 |
| JP | 2005-189388 | | 7/2005 |
| JP | 2005-202209 | | 7/2005 |
| JP | 2005-215102 | | 8/2005 |
| JP | 2005-345722 | | 12/2005 |
| JP | 2005-345723 | | 12/2005 |
| JP | 2006-259714 | | 9/2006 |
| JP | 2007-310034 | | 11/2007 |
| JP | 2007-310311 | A | 11/2007 |

OTHER PUBLICATIONS

Extended European Search Report issued Apr. 3, 2009 for corresponding European Application No. 07 25 2040.

Extended European Search Report issued Jun. 1, 2011 for corresponding European Application No. 11 15 6768.

European Patent Office Communication Pursuant to Article 94(3) EPC issued Sep. 29, 2012 in corresponding European Application No. 11 156 768.1.

Korean Intellectual Property Office Notice Requesting Submission of Opinion issued Aug. 12, 2013 for corresponding Korean Application No. 10-2007-0048456.

* cited by examiner

FIG.9A
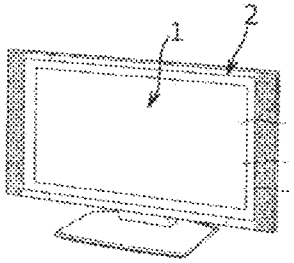
FIG.9B
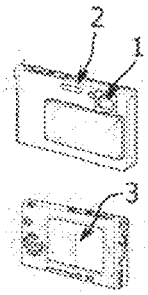
FIG.9D
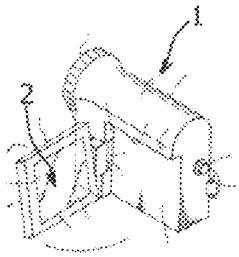
FIG.9C
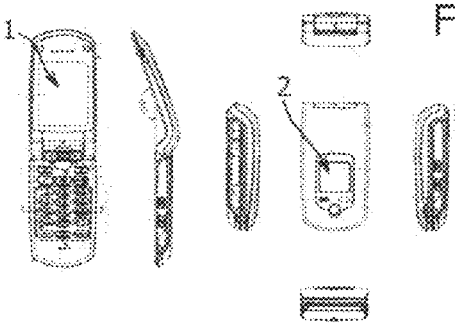
FIG.9G
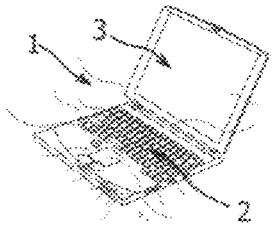
FIG.9E
FIG.9F
FIG.10
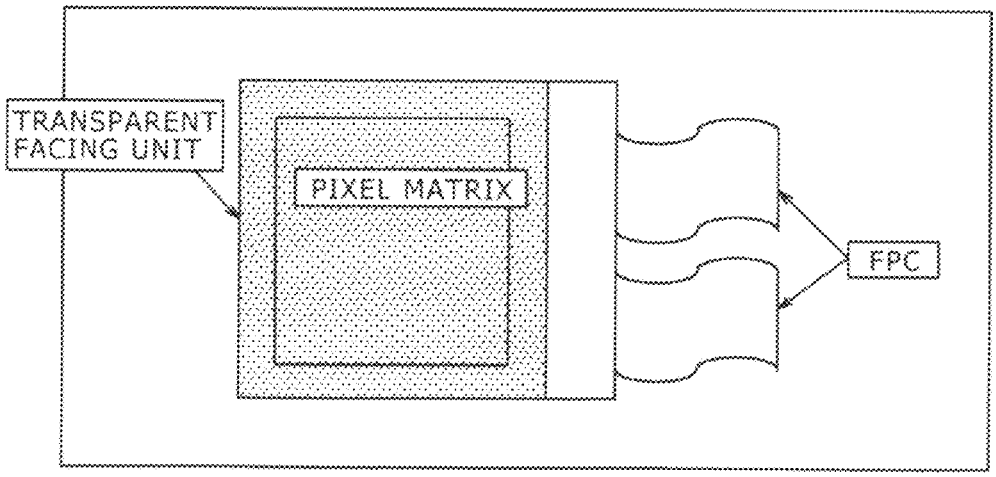

DISPLAY APPARATUS AND METHOD OF DRIVING SAME

CROSS REFERENCES TO RELATED APPLICATIONS

This is a Continuation Application of U.S. patent application Ser. No. 11/802,150, filed May 21, 2007, which claims priority from Japanese Patent Application JP 2006-141836 filed in the Japan Patent Office on May 22, 2006, the entire contents of which are incorporated herein by reference.

BACKGROUND OF THE INVENTION

1. Field of the Invention

The present invention relates to an active-matrix display apparatus having light-emitting devices as pixels thereof and a method of driving such an active-matrix display apparatus.

2. Description of the Related Art

In recent years, growing efforts have been made to develop flat, self-emission display apparatuses using organic EL devices as light-emitting devices. An organic EL device is a device utilizing a phenomenon in which an organic thin film emits light under an electric field. The organic EL device has a low power requirement because it can be energized under a low voltage of 10 V or lower. Since the organic EL device is a self-emission device for emitting light by itself, it requires no illuminating members, and hence it can be lightweight and have a low profile. The organic EL device does not produce an image lag when it displays moving images because the response speed thereof is a very high value of about several μs.

Of flat self-emission display apparatuses using organic EL devices as pixels, active-matrix display apparatuses including thin-film transistors integrated in respective pixels as drive elements are particularly under active development. Active-matrix flat self-emission display apparatuses are disclosed in Japanese Laid-open Patent Publication Nos. 2003-255856, 2003-271095, 2004-133240, 2004-029791, and 2004-093682.

SUMMARY OF THE INVENTION

In the existing active-matrix, flat, self-emission display apparatus, transistors for driving light-emitting devices have various threshold voltages and mobilities due to fabrication process variations. In addition, the characteristics of the organic EL devices tend to vary with time. Such characteristic variations of the drive transistors and characteristic variations of the organic EL devices adversely affect the light emission luminance. For uniformly controlling the light emission luminance over the entire screen surface of the display apparatus, it is necessary to correct the above characteristic variations of the drive transistors and the organic EL devices in pixel circuits. Heretofore, there have been proposed display apparatuses having a correcting function at each pixel. However, existing pixel circuits with a correcting function are complex in structure as they demand an interconnect for supplying a correcting potential, a switching transistor, and a switching pulse. Because each of the pixel circuits has many components, they have presented obstacles to efforts to achieve a higher-definition display.

It is desirable to provide a display apparatus for achieving a higher-definition display with simplified pixel circuits and a method of driving such a display apparatus.

According to an embodiment of the present invention, there is provided a display apparatus including a pixel array and a driver configured to drive the pixel array, the pixel array having scanning lines as rows, signal lines as columns, a matrix of pixels disposed at respective intersections of the scanning lines and the signal lines, and power supply lines disposed along respective rows of the pixels, the driver having a main scanner for successively supplying control signals to the scanning lines to perform line-sequential scanning on the rows of the pixels, a power supply scanner for supplying a power supply voltage, which selectively switches between a first potential and a second potential, to the power supply lines in synchronism with the line-sequential scanning, and a signal selector for supplying a signal potential, which serves as a video signal, and a reference potential to the signal lines as the columns in synchronism with the line-sequential scanning, each of the pixels including a light-emitting device, a sampling transistor, a drive transistor, and a retention capacitor, the sampling transistor having a gate, a source, and a drain, the gate being connected to one of the scanning lines, either one of the source and the drain being connected to one of the signal lines, and the other of the source and the drain being connected to the gate of the drive transistor, the drive transistor having a source and a drain, either one of which is connected to the light-emitting device and the other connected to one of the power supply lines, the retention capacitor being connected between the source and gate of the drive transistor, wherein the sampling transistor is rendered conductive depending on the control signal supplied from the scanning line, samples the signal potential supplied from the signal line, and retains the sampled signal potential in the retention capacitor, the drive transistor is supplied with a current from the power supply line at the first potential, and passes a drive current to the light-emitting device depending on the signal potential retained in the retention capacitor, and the power supply scanner switches the power supply line between the first potential and the second potential while the signal selector is supplying the reference potential to the signal line after the sampling transistor is rendered conductive, thereby retaining a voltage which essentially corresponds to the threshold voltage of the drive transistor in the retention capacitor.

Preferably, the signal selector switches the signal line from the reference potential to the signal potential at a first timing after the sampling transistor is rendered conductive, the main scanner stops applying the control signal to the scanning line at a second timing after the first timing, thereby rendering the sampling transistor nonconductive, and the period between the first timing and the second timing is appropriately set to correct the signal potential as it is retained in the retention capacitor with respect to the mobility of the drive transistor. The driver adjusts the relative phase difference between the video signal supplied from the signal selector and the control signal supplied from the main scanner to optimize the period between the first timing and the second timing. The signal selector applies a gradient to a positive-going edge of the video signal which switches from the reference potential to the signal potential, thereby allowing the period between the first timing and the second timing to automatically follow the signal potential. When the signal potential is retained by the retention capacitor, the main scanner stops applying the control signal to the scanning line, thereby rendering the sampling transistor nonconductive to electrically disconnect the gate of the drive transistor from the signal line, so that the gate potential of the drive transistor is linked to a variation of the source potential of the drive transistor to keep constant the voltage between the gate and the source of the drive transistor.

According to an embodiment of the present invention, there also is provided a display apparatus including a pixel array and a driver configured to drive the pixel array, the pixel array having scanning lines as rows, signal lines as columns, a matrix of pixels disposed at respective intersections of the scanning lines and the signal lines, and power supply lines disposed along respective rows of the pixels, the driver having a main scanner for successively supplying control signals to the scanning lines to perform line-sequential scanning on the rows of the pixels, a power supply scanner for supplying a power supply voltage, which selectively switches between a first potential and a second potential, to the power supply lines in synchronism with the line-sequential scanning, and a signal selector for supplying a signal potential, which serves as a video signal, and a reference potential to the signal lines as the columns in synchronism with the line-sequential scanning, each of the pixels including a light-emitting device, a sampling transistor, a drive transistor, and a retention capacitor, the sampling transistor having a gate, a source, and a drain, the gate being connected to one of the scanning lines, either one of the source and the drain being connected to one of the signal lines, and the other of the source and the drain being connected to the gate of the drive transistor, the drive transistor having a source and a drain, either one of which is connected to the light-emitting device and the other connected to one of the power supply lines, the retention capacitor being connected between the source and gate of the drive transistor, wherein the sampling transistor is rendered conductive depending on the control signal supplied from the scanning line, samples the signal potential supplied from the signal line, and retains the sampled signal potential in the retention capacitor, the drive transistor is supplied with a current from the power supply line at the first potential, and passes a drive current to the light-emitting device depending on the signal potential retained in the retention capacitor, the signal selector switches the signal line from the reference potential to the signal potential at a first timing after the sampling transistor is rendered conductive, the main scanner stops applying the control signal to the scanning line at a second timing after the first timing, thereby rendering the sampling transistor nonconductive, and the period between the first timing and the second timing is appropriately set to correct the signal potential as it is retained in the retention capacitor with respect to the mobility of the drive transistor.

Preferably, the driver adjusts the relative phase difference between the video signal supplied from the signal selector and the control signal supplied from the main scanner to optimize the period between the first timing and the second timing. The signal selector applies a gradient to a positive-going edge of the video signal which switches from the reference potential to the signal potential at a first timing, thereby allowing the period between the first timing and the second timing to automatically follow the signal potential. The main scanner stops applying the control signal to the scanning line at the second timing at which the signal potential is retained in the retention capacitor, thereby rendering the sampling transistor nonconductive to electrically disconnect the gate of the drive transistor from the signal line, so that the gate potential of the drive transistor is linked to a variation of the source potential of the drive transistor to keep constant the voltage between the gate and the source of the drive transistor. The power supply scanner switches the power supply line between the first potential and the second potential while the signal selector is supplying the reference potential to the signal line after the sampling transistor is rendered conductive, thereby retaining a voltage which corresponds to the threshold voltage of the drive transistor in the retention capacitor.

The display apparatus according to an embodiment of the present invention has a threshold voltage correcting function, a mobility correcting function, and a bootstrapping function in each of the pixels. The threshold voltage correcting function corrects a variation of the threshold voltage of the drive transistor. The mobility correcting function corrects a variation of the mobility of the drive transistor. The bootstrapping operation of the retention capacitor at the time the light-emitting device emits light is effective to keep the light emission luminance at a constant level at all times regardless of characteristic variations of an organic EL device used as the light-emitting device. Specifically, even if the current vs. voltage characteristics of the organic EL device vary with time, since the gate-to-source voltage of the drive transistor is kept constant by the retention capacitor that is bootstrapped, the light emission luminance is maintained at a constant level.

In order to incorporate the threshold voltage correcting function, the mobility correcting function, and the bootstrapping function into each of the pixels, the power supply voltage supplied to each of the pixels is applied as switching pulses. With the power supply voltage applied as switching pulses, a switching transistor for correcting the threshold voltage and a scanning line for controlling the gate of the switching transistor are not demanded. As a result, the number of components and interconnects of the pixel is greatly reduced, making it possible to reduce the pixel area for providing higher-definition display. The mobility correcting period can be adjusted based on the phase difference between the video signal and the sampling pulse by correcting the mobility simultaneously with the sampling of the video signal potential. Furthermore, the mobility correcting period can be controlled to automatically follow the level of the video signal. Because the number of components of the pixel is small, any parasitic capacitance added to the gate of the drive transistor is small, so that the retention capacitor can be bootstrapped, reliably, thereby improving the ability to correct a time-depending variation of the organic EL device.

According to an embodiment of the present invention, a display apparatus has an active-matrix display apparatus employing light-emitting devices such as organic EL devices as pixels, each of the pixels having a threshold voltage correcting function for the drive transistor, a mobility correcting function for the drive transistor, and a function to correct a time-depending variation of the organic EL device (bootstrapping function) for allowing the display apparatus to display high-quality images. Since the mobility correcting period can be set automatically depending on the video signal potential, the mobility can be corrected regardless of the luminance and pattern of displayed images. An existing pixel circuit with such correcting functions is made of a large number of components, has a large layout area, and hence is not suitable for providing higher-definition display. According to an embodiment of the present invention, however, since the power supply voltage is applied as switching pulses, the number of components and interconnects of the pixel is greatly reduced, making it possible to reduce the pixel layout area. Consequently, the display apparatus according to an embodiment of the present invention can be provided as a high-quality, high-definition, flat display unit.

BRIEF DESCRIPTION OF THE DRAWINGS

FIGS. 9(*a*) through 9(*g*) are views showing specific examples of electronic unit display apparatus; and FIG. 10 is a plan view of a module.

DETAILED DESCRIPTION OF THE PREFERRED EMBODIMENTS

Figure 1:
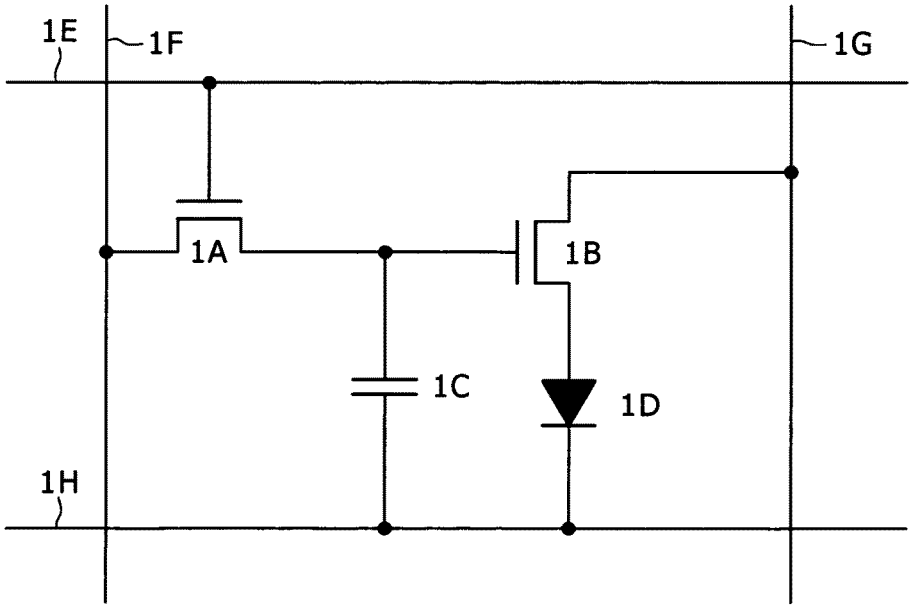
FIG. 1 is a circuit diagram of a general pixel structure.

For an easier understanding of the present invention and a clarification of the background thereof, a general structure of a display apparatus will be described initially below with reference to FIG. 1. FIG. 1 is a circuit diagram showing a pixel of a general display apparatus. As shown in FIG. 1, the pixel circuit has a sampling transistor 1A disposed at the intersection of a scanning line 1E and a signal line 1F which extend perpendicularly to each other. The sampling transistor 1A is an N-type transistor having a gate connected to the scanning line 1E and a drain connected to the signal line 1F. The sampling transistor 1A has a source connected to an electrode of a retention capacitor 1C and the gate of a drive transistor 1B. The drive transistor 1B is a N-type transistor having a drain connected to a power supply line 1G and a source connected to the anode of a light-emitting device 1D. The other electrode of the retention capacitor 1C and the cathode of the light-emitting device 1D are connected to a ground line 1H.

Figure 2:
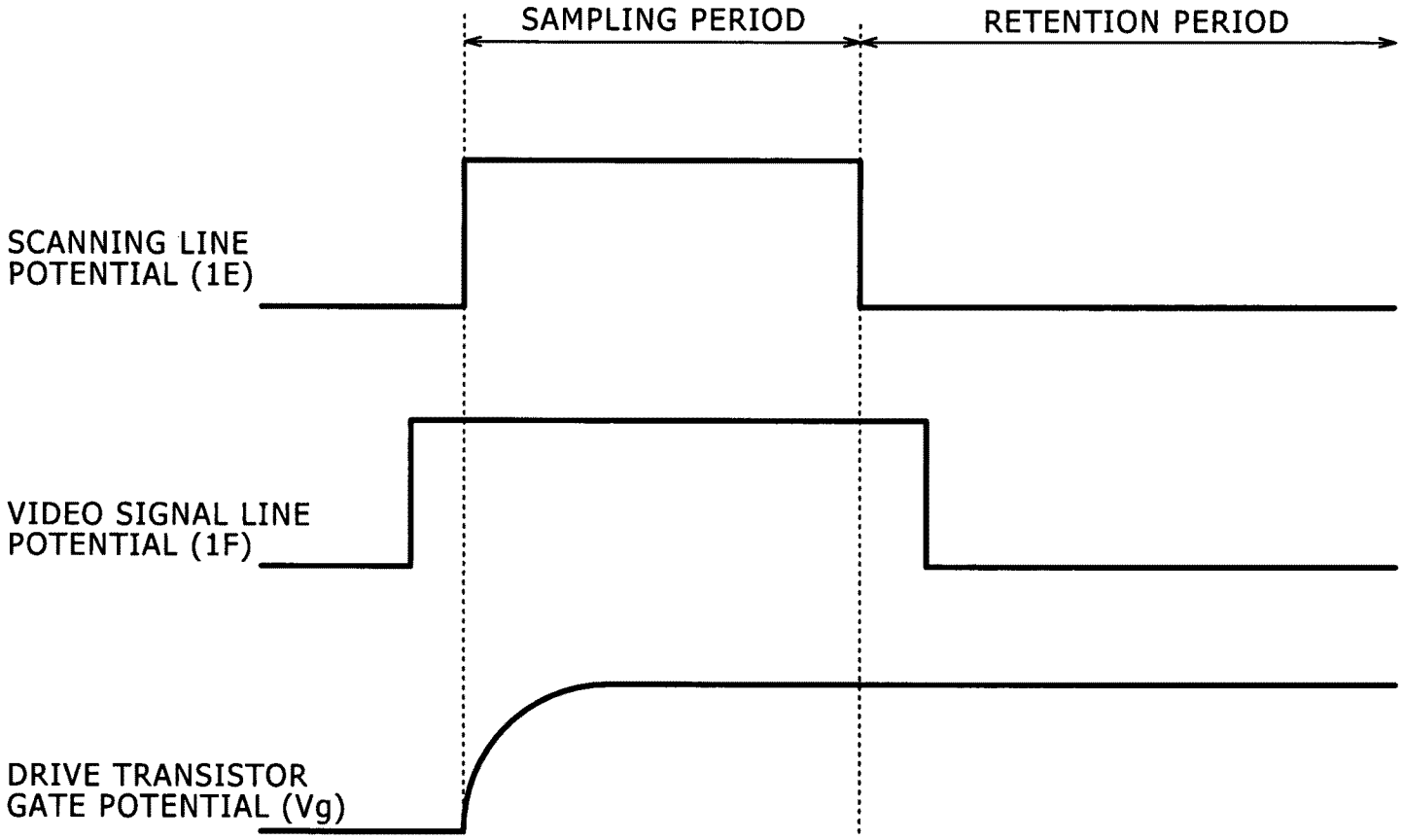
FIG. 2 is a timing chart illustrative of an operation sequence of the pixel circuit shown in FIG. 1.

FIG. 2 is a timing chart illustrative of an operation sequence of the pixel circuit shown in FIG. 1. The timing chart shows an operation sequence for sampling the potential of a video signal supplied from the signal line 1F (video signal line potential) and bringing the light-emitting device 1D, which may be an organic EL device, into a light-emitting state. When the potential of the scanning line 1E (scanning line potential) goes high, the sampling transistor 1A is turned on, charging the retention capacitor 1C with the video signal line potential. The gate potential Vg of the drive transistor 1B starts rising, and the drive transistor 1B starts to pass a drain current. Therefore, the anode potential of the light-emitting device D increases, causing the light-emitting device D to start to emit light. When the scanning line potential goes low, the retention capacitor 1C retains the video signal line potential, keeping the gate potential of the drive transistor 1B constant. The light emission luminance of the light-emitting device D is kept constant until the next frame.

The pixels of the display apparatus suffer threshold voltage and mobility variations due to fabrication process variations of the drive transistors 1B of the pixel circuits. Because of those characteristic variations, even when the same gate potential is applied to the drive transistors 1B of the pixel circuits, the pixels have their own drain current (drive current) variations, which will appear as light emission luminance variations. Furthermore, the light-emitting device 1D, which may be an organic EL device, has its characteristics varying with time, resulting in a variation of the anode potential of the light-emitting device 1D. The variation of the anode potential of the light-emitting device 1D causes a variation of the gate-to-source voltage of the drive transistor 1B, bringing about a variation of the drain current (drive current). The variations of the drive currents due to the various causes result in light emission luminance variations of the pixels, tending to degrade the displayed image quality.

Figure 3A:
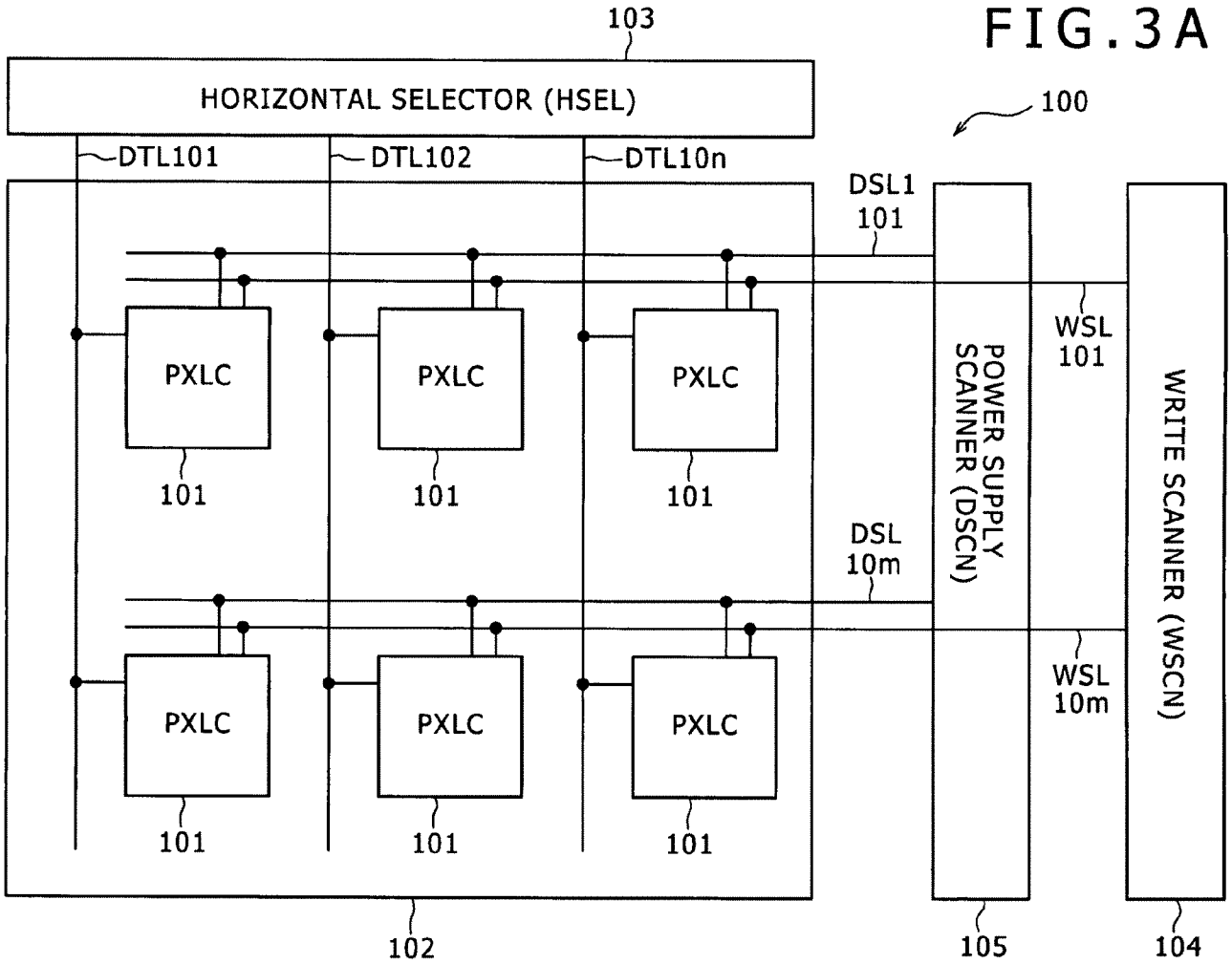
FIG. 3A is a block diagram of an overall arrangement of a display apparatus according to an embodiment of the present invention.

FIG. 3A shows in block form an overall arrangement of a display apparatus according to an embodiment of the present invention. As shown in FIG. 3A, the display apparatus, generally denoted by 100, includes a pixel array 102 and a driver 103, 104, 105. The pixel array 102 has a plurality of scanning lines WSL101 through WSL10*m* provided as rows, a plurality of signal lines DTL101 through DTL10*n* provided as columns, a matrix of pixels (PXLC) 101 disposed at the respective intersections of the scanning lines WSL101 through WSL10*m* and the signal lines DTL101 through DTL10*n*, and a plurality of power supply lines DSL101 through DSL10*m* disposed along the respective rows of the pixels 101. The driver includes a main scanner (write scanner WSCN) 104 for successively supplying control signals to the scanning lines WSL101 through WSL10*m* to perform line-sequential scanning on the rows of the pixels 101, a power supply scanner (DSCN) 105 for supplying a power supply voltage, which selectively switches between a first potential and a second potential, to the power supply lines DSL101 through DSL10*m* in synchronism with the line-sequential scanning, and a signal selector (horizontal selector (HSEL)) 103 for supplying a signal potential, which serves as a video signal, and a reference potential to the signal lines DTL101 through DTL10*n* as the columns in synchronism with the line-sequential scanning.

Figure 3B:
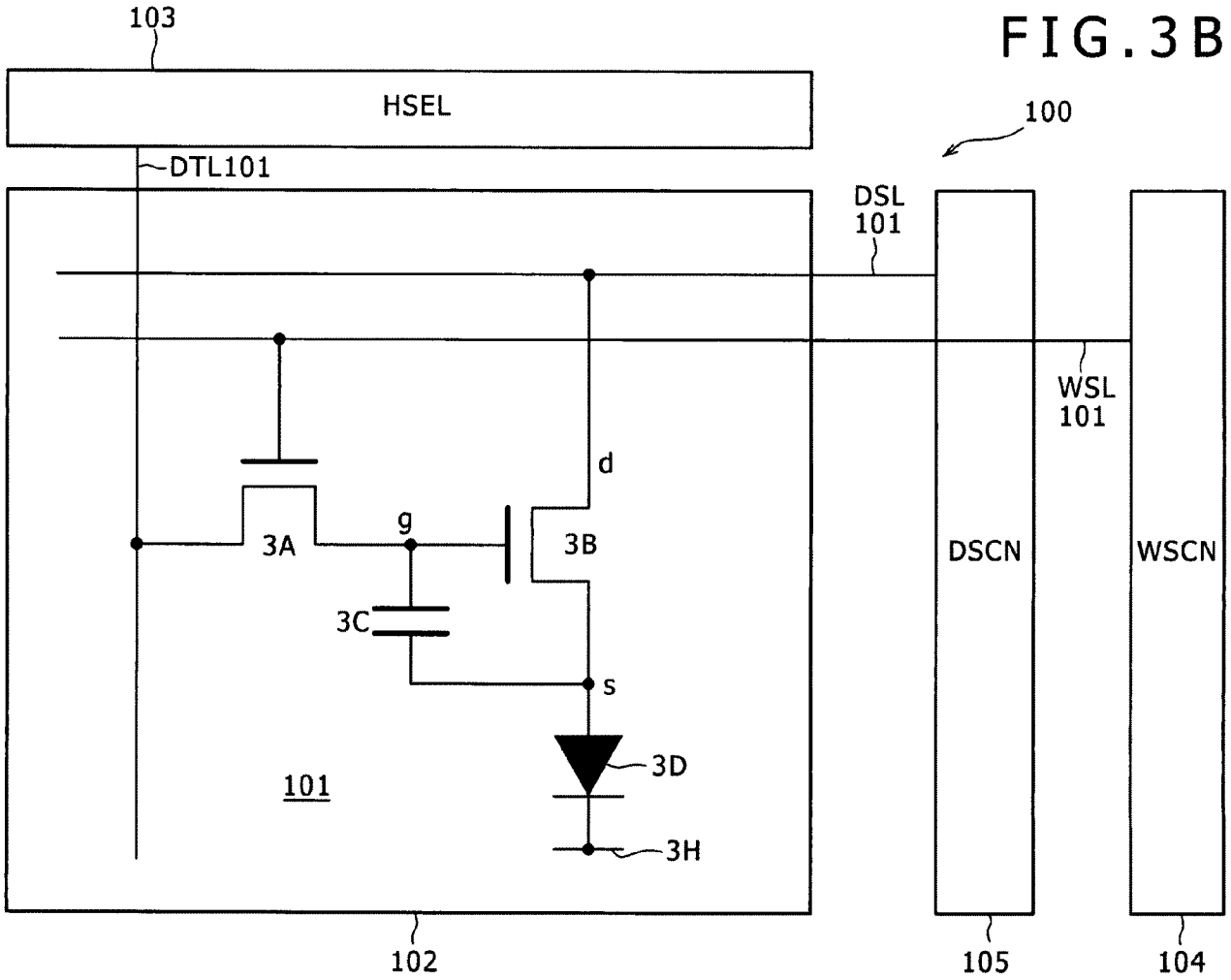
FIG. 3B is a circuit diagram of a pixel circuit of the display apparatus according to an embodiment of the present invention.

FIG. 3B is a circuit diagram showing specific structural details and interconnects of each of the pixels 101 of the display apparatus 100 shown in FIG. 3A. As shown in FIG. 3B, the pixel 101 includes a light-emitting device 3D, which may typically be an organic EL device, a sampling transistor 3A, a drive transistor 3B, and a retention capacitor 3C. The sampling transistor 3A has a gate connected to the corresponding scanning line WSL101. Either one of the source and drain of the sampling transistor 3A is connected to the corresponding signal line DTL101, and the other connected to the gate g of the drive transistor 3B. The drive transistor 3B has a source s and a drain d, either one of which is connected to the light-emitting device 3D, and the other connected to the corresponding power supply line DSL101. In the present embodiment, the drain d of the drive transistor 3B is connected to the power supply line DSL101, and the source s of the drive transistor 3B is connected to the anode of the light-emitting device 3D. The cathode of the light-emitting device 3D is connected to a ground line 3H. The ground line 3H is connected in common to all the pixels 101. The retention capacitor 3C is connected between the source s and gate g of the drive transistor 3B.

The sampling transistor 3A is rendered conductive by a control signal supplied from the scanning line WSL101, samples a signal potential supplied from the signal line DTL101, and retains the sampled signal potential in the retention capacitor 3C. The drive transistor 3B is supplied with a current from the power supply line DSL101 at the first potential, and passes a drive current to the light-emitting device 3D depending on the signal potential retained in the retention capacitor 3C. After the sampling transistor 3A is rendered conductive, while the signal selector (HSEL) 103 is supplying the reference potential to the signal line DTL101, the power supply scanner (DSCN) 105 switches the power supply line DSL101 from the first potential to the second potential, retaining a voltage which essentially corresponds to the threshold voltage Vth of the drive transistor 3B in the retention capacitor 3C. Such a threshold voltage correcting function allows the display apparatus 100 to cancel the effect of the threshold voltage of the drive transistor 3B which varies from pixel to pixel.

The pixel 101 shown in FIG. 3B has a mobility correction function in addition to the above threshold voltage correcting function. Specifically, after the sampling transistor 3A is rendered conductive, the signal selector (HSEL) 103 switches the signal line DTL101 from the reference potential to the signal potential at a first timing, and the main scanner (WSCN) 104 stops applying the control signal to the scanning line WSL101 at a second timing after the first timing, thereby rendering the sampling transistor 3A nonconductive. The period between the first timing and the second timing is appropriately set to correct the signal potential as it is retained in the retention capacitor 3C, which is corrected with respect to the mobility μ of the drive transistor 3B. The driver 103, 104, 105 can adjust the relative phase difference between the video signal supplied by the signal selector 103 and the control signal supplied by the main scanner 104, thereby optimizing the period between the first timing and the second timing (mobility correcting period). The signal selector 103 also can apply a gradient to the positive-going edge of the video signal which switches from the reference potential to the signal potential, thereby allowing the mobility correcting period between the first timing and the second timing to automatically follow the signal potential.

The pixel 101 shown in FIG. 3B also has a bootstrap function. Specifically, at the time the signal potential is retained by the retention capacitor 3C, the main scanner (WSCN) 104 stops applying the control signal to the scanning line WSL101, thereby rendering the sampling transistor 3A nonconductive so as to electrically disconnect the gate g of the drive transistor 3B from the signal line DTL101. Therefore, the gate potential Vg is linked to a variation of the source potential Vs of the drive transistor 3B to keep constant the voltage Vgs between the gate g and the source s.

Figure 4A:
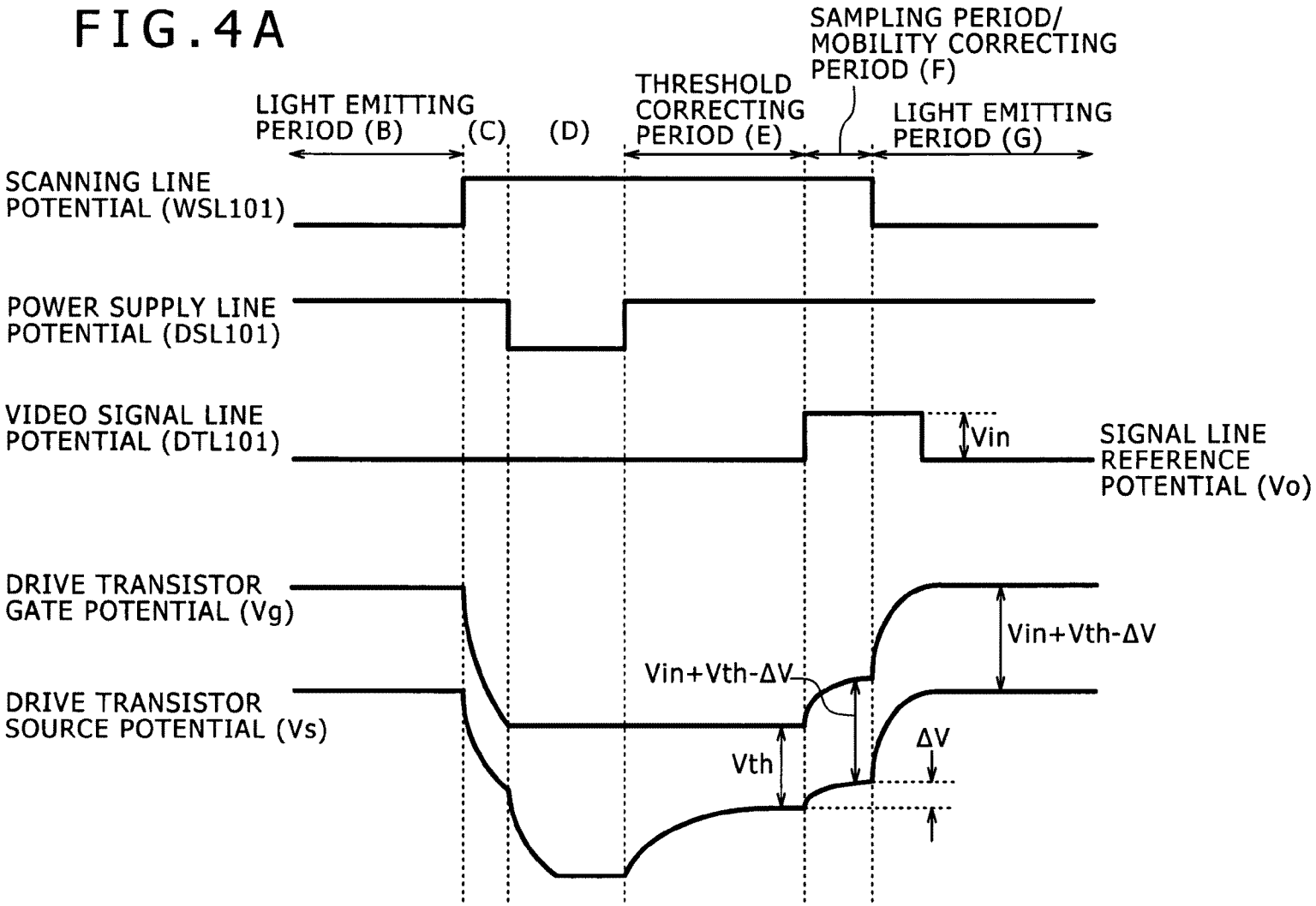
FIG. 4A is a timing chart illustrative of an operation sequence of the pixel circuit shown in FIG. 3B.

FIG. 4A is a timing chart illustrative of an operation sequence of the pixel 101 shown in FIG. 3B. FIG. 4A shows potential changes of the scanning line WSL101, potential changes of the power supply line DSL101, and potential changes of the signal line DTL101 against a common time axis. FIG. 4A also shows changes in the gate potential Vg and the source potential Vs of the drive transistor 3B in addition to the above potential changes.

The timing chart shown in FIG. 4A is divided into different periods (B) through (G) of operation of the pixel 101. Specifically, the light-emitting device 3D is in a light-emitting state in a light-emitting period (B). Thereafter, a new field of line-sequential scanning begins, and the gate potential Vg of the drive transistor 3B is initialized in a first period (C). Then, in a next period (D), the source potential Vs of the drive transistor 3B is initialized. When the gate potential Vg and the source potential Vs of the drive transistor 3B are initialized, the pixel 101 is fully prepared for its threshold voltage correcting operation. In a threshold correcting period (E), the threshold voltage correcting operation is actually performed to retain a voltage which essentially corresponds to the threshold voltage Vth between the gate g and the source s of the drive transistor 3B. In reality, the voltage corresponding to Vth is written in the retention capacitor 3C that is connected between the gate g and the source s of the drive transistor 3B. Then, in a sampling period/mobility correcting period (F), the signal potential Vin of the video signal is rewritten in the retention capacitor 3C in addition to the threshold voltage Vth, and a voltage ΔV for correcting the mobility is subtracted from the voltage retained in the retention capacitor 3C. Thereafter, in a light-emitting period (G), the light-emitting device 3D emits light at a luminance level depending on the signal voltage Vin. Since the signal voltage Vin has been adjusted by the voltage which essentially corresponds to the threshold voltage Vth and the mobility correcting voltage ΔV, the light emission luminance of the light-emitting device 3D is not adversely affected by the threshold voltage Vth and the mobility μ of the drive transistor 3B. A bootstrap operation is performed in an initial phase of the light-emitting period (G) to increase the gate potential Vg and the source potential Vs of the drive transistor 3B while keeping constant the gate-to-source voltage Vgs=Vin+Vth−ΔV of the drive transistor 3B.

Figure 4B:
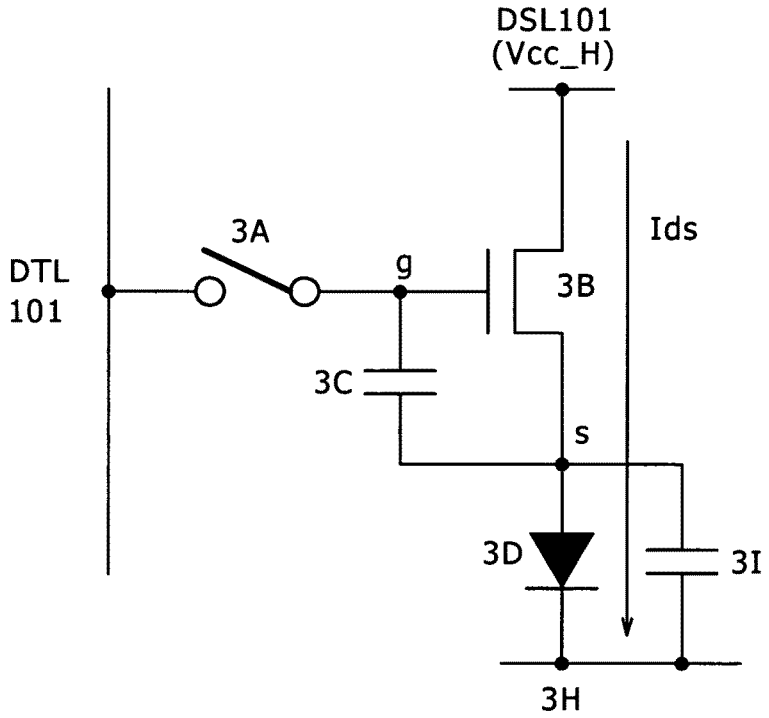
FIG. 4B is a circuit diagram illustrative of the manner in which the pixel circuit shown in FIG. 3B operates.

The operation of the pixel 101 shown in FIG. 3B will be described in detail below with reference to FIGS. 4B through 4G. FIGS. 4B through 4G show different operational stages which correspond respectively to the periods (B) through (G) of the timing chart shown in FIG. 4A. For an easier understanding of the invention, a capacitive component of the light-emitting device 3D is illustrated as a capacitive element 31 in each of FIGS. 4B through 4G. As shown in FIG. 4B, in the light-emitting period (B), the power supply line DSL101 is at a high potential Vcc_H (the first potential), and the drive transistor 3B supplies a drive current Ids to the light-emitting device 3D. The drive current Ids flows from the power supply line DSL101 at the high potential Vcc_H through the drive transistor 3B and the light-emitting device 3D into the common ground line 3H.

Figure 4C:
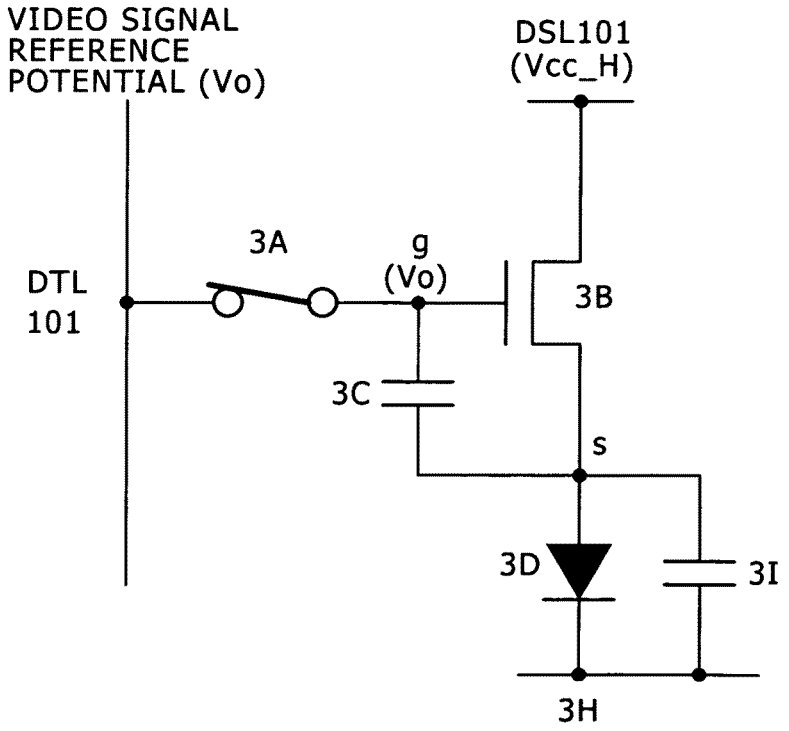
FIG. 4C is a circuit diagram illustrative of the manner in which the pixel circuit shown in FIG. 3B operates.

In the period (C), as shown in FIG. 4C, the scanning line WSL101 goes high, turning on the sampling transistor 3A to initialize (reset) the gate potential Vg of the drive transistor 3B to the reference potential Vo of the video signal line DTL101.

Figure 4D:
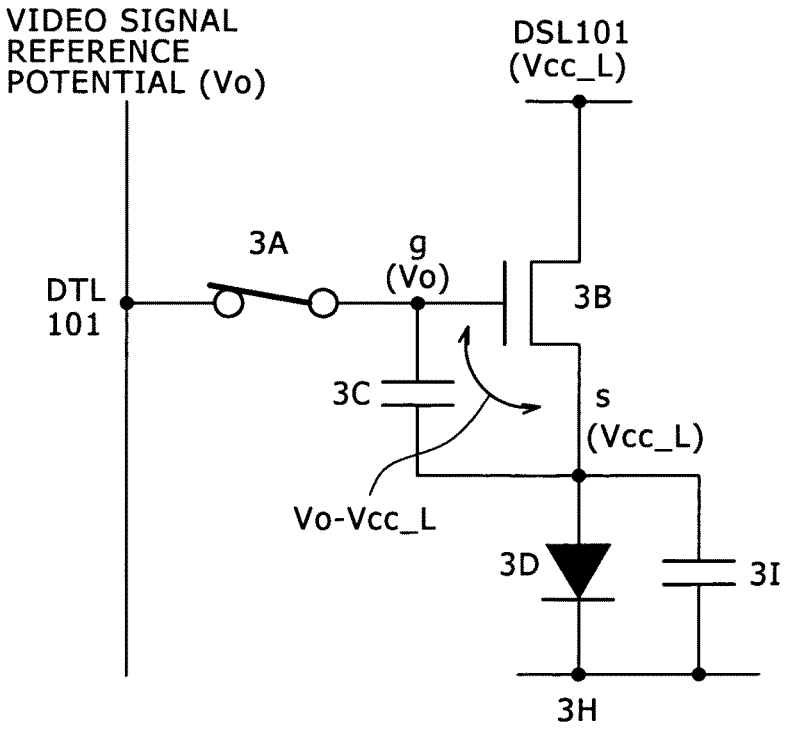
FIG. 4D is a circuit diagram illustrative of the manner in which the pixel circuit shown in FIG. 3B operates.

In the period (D), as shown in FIG. 4D, the power supply line DSL101 switches from the high potential Vcc_H (the first potential) to a low potential Vcc_L (the second potential) which is sufficiently lower than the reference potential Vo of the video signal line DTL101. The source potential Vs of the drive transistor 3B is initialized (reset) to the low potential Vcc_L which is sufficiently lower than the reference potential Vo of the video signal line DTL101. Specifically, the low potential Vcc_L (the second potential) of the power supply line DSL101 is established such that the gate-to-source voltage Vgs (the difference between the gate potential Vg and the source potential Vs) of the drive transistor 3B is greater than the threshold voltage Vth of the drive transistor 3B.

Figure 4E:
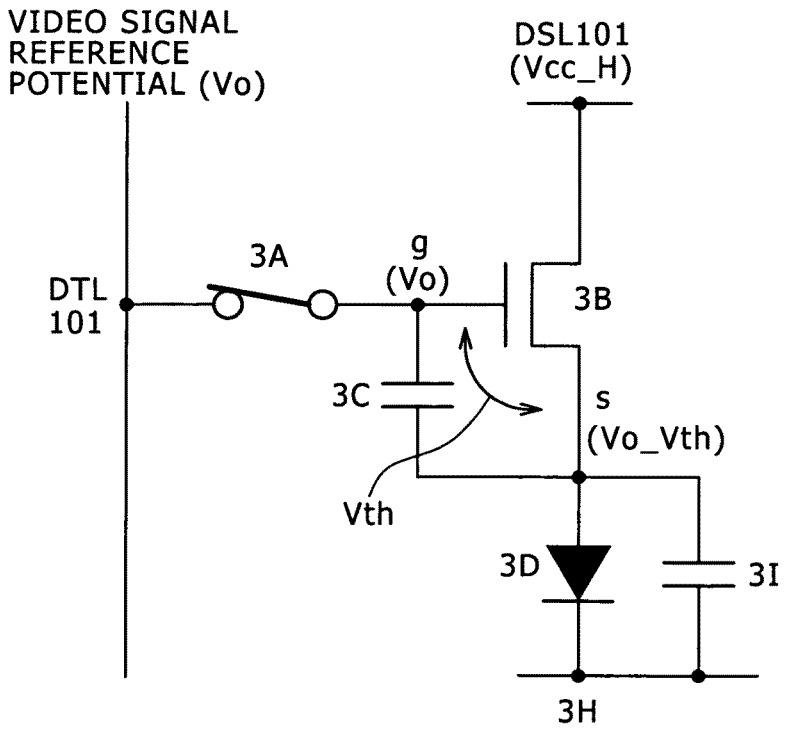
FIG. 4E is a circuit diagram illustrative of the manner in which the pixel circuit shown in FIG. 3B operates.

In threshold correcting period (E), as shown in FIG. 4(E), the power supply line DSL101 switches from the low potential Vcc_L to the high potential Vcc_H, and the source potential Vs of the drive transistor 3B starts increasing. When the gate-to-source voltage Vgs of the drive transistor 3B reaches the threshold voltage Vth, the current is cut off. In this manner, the voltage which essentially corresponds to the threshold voltage Vth of the drive transistor 3B is written in the retention capacitor 3C. This process is referred to as the threshold voltage correcting operation. In order to cause the current to flow only into the retention capacitor 3C, but not to the light-emitting device 3D, the potential of the common ground line 3H is set to cut off the light-emitting device 3D.

Figure 4F:
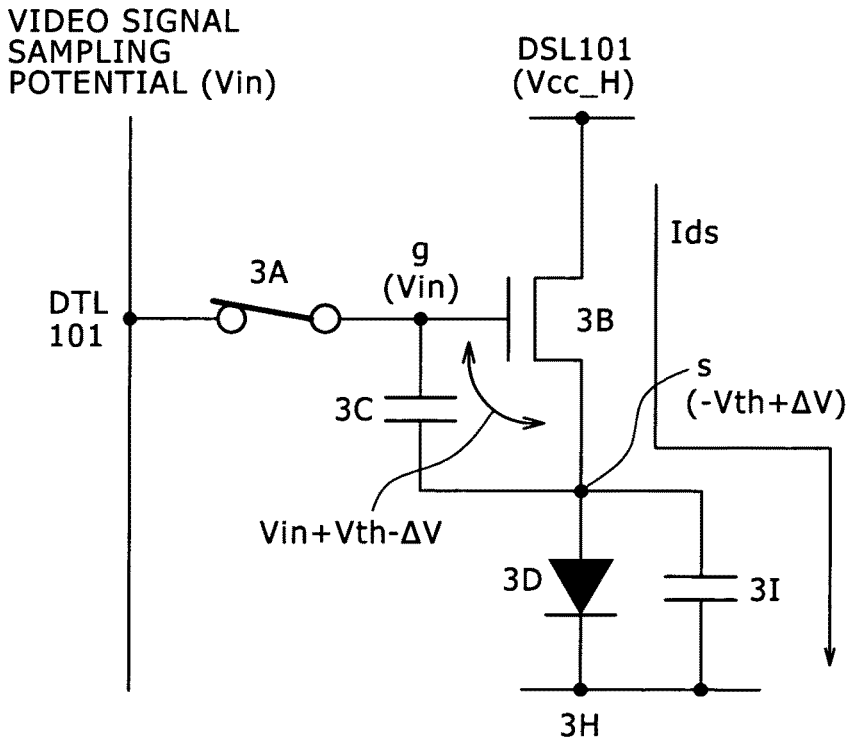
FIG. 4F is a circuit diagram illustrative of the manner in which the pixel circuit shown in FIG. 3B operates.

In the sampling period/mobility correcting period (F), as shown in FIG. 4F, the video signal line DTL101 changes from the reference potential Vo to the signal potential Vin at the first timing, setting the gate potential Vg of the drive transistor 3B to Vin. Since the light-emitting device 3D is initially cut off (at a high impedance) at this time, the drain current Ids of the drive transistor 3B flows into the parasitic capacitance 3I of the light-emitting device 3D. The parasitic capacitance 3I of the light-emitting device 3D now starts being charged. Therefore, the source potential Vs of the drive transistor 3B starts to increase, and the gate-to-source voltage Vgs of the drive transistor 3B reaches Vin+Vth−ΔV at the second timing. In this manner, the signal potential Vin is sampled, and the correction variable ΔV is adjusted. As Vin is higher, Ids is greater and the absolute value of ΔV is greater. Therefore, the mobility correction depending on the light emission luminance level can be performed. If Vin is constant, then the absolute value of ΔV is greater as the mobility μ of the drive transistor 3B is greater. Stated otherwise, since the negative feedback variable ΔV is greater as the mobility μ is greater, it is possible to remove variations of the mobility μ for the respective pixels.

Figure 4G:
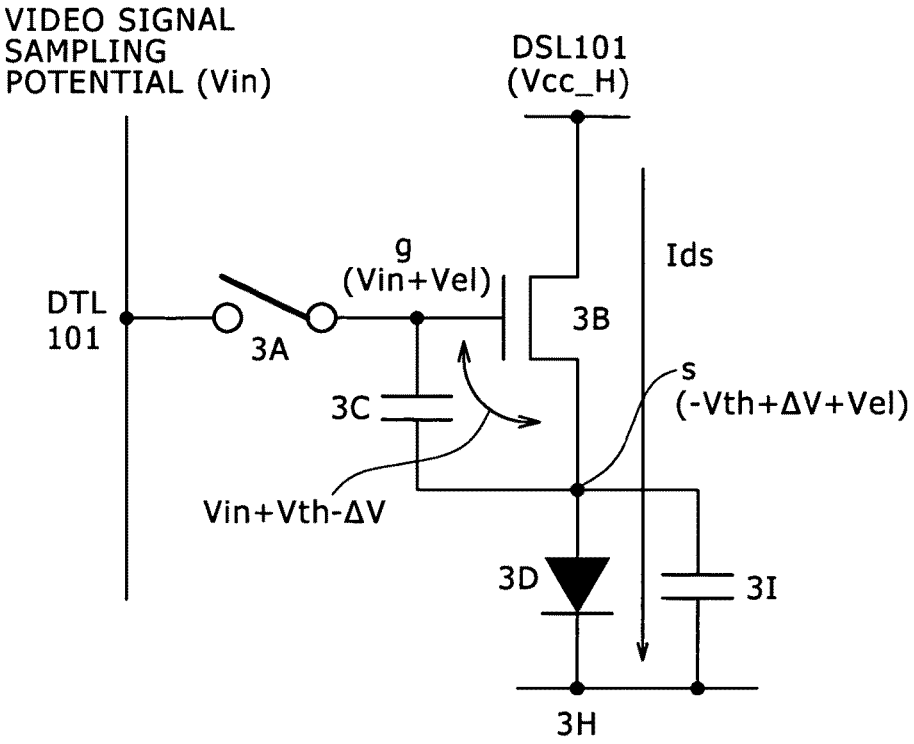
FIG. 4G is a circuit diagram illustrative of the manner in which the pixel circuit shown in FIG. 3B operates.

Finally, in the light-emitting period (G), as shown in FIG. 4G, the scanning line WSL101 goes to the low potential, turning off the sampling transistor 3A. The gate g of the drive transistor 3B is now separated from the signal line DTL101. At the same time, the drain current Ids starts flowing into the light-emitting device 3D. The anode potential of the light-emitting device 3D increases depending on the drive current Ids. The increase in the anode potential of the light-emitting device 3D is equivalent to an increase in the source potential Vs of the drive transistor 3B. As the source potential Vs of the drive transistor 3B, the gate potential Vg of the drive transistor 3B also increases because of the bootstrapping operation of the retention capacitor 3C. The increased amount of the gate potential Vg is equal to the increased amount of the source potential Vs. Consequently, the gate-to-source voltage Vgs of the drive transistor 3B is maintained at the constant level of Vin+Vth−ΔV during the light-emitting period.

Figure 5:
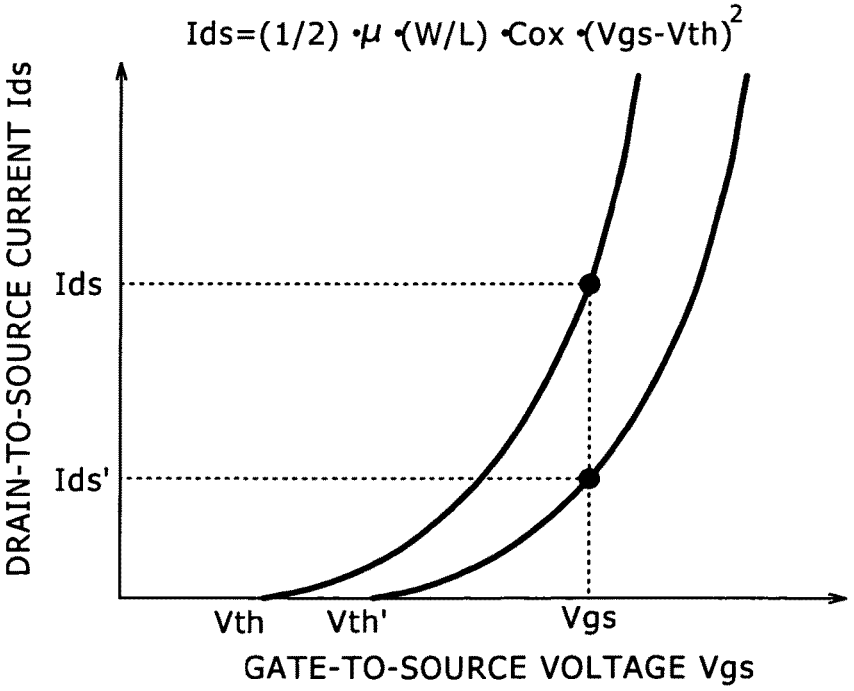
FIG. 5 is a graph showing current vs. voltage characteristics of a drive transistor.

FIG. 5 is a graph showing current vs. voltage characteristics of the drive transistor 3B. The drain-to-source current Ids of the drive transistor 3B while it is operating in a saturated region is expressed as $Ids=(½)\cdot\mu\cdot(W/L)\cdot Cox\cdot(Vgs-Vth)2$, where μ represents the mobility, W represents the gate width, L represents the gate length, and Cox represents the gate oxide film capacitance per unit area. As can be seen from this transistor characteristic equation, when the threshold voltage Vth varies, the drain-to-source current Ids varies even if Vgs is constant. Since the gate-to-source voltage Vgs is expressed as Vin+Vth−ΔV when the pixel is emitting light, if Vgs=Vin+Vth−ΔV is substituted in the above transistor characteristic equation, then the drain-to-source current Ids is expressed as $Ids=(½)\cdot\mu\cdot(W/L)\cdot Cox\cdot(Vin-\Delta V)2$, and does not depend on the threshold voltage Vth. As a result, even if the threshold voltage Vth varies due to the fabrication process, drain-to-source current. Ids does not vary, and hence the light emission luminance, of the organic EL device does not vary.

If no countermeasure is taken, then, as shown in FIG. 5, the drive current corresponding to the gate voltage Vgs at the time the threshold voltage is Vth is indicated by Ids, whereas the drive current corresponding to the same gate voltage Vgs when the threshold voltage is Vth' is indicated by Ids', which is different from Ids.

Figure 6A:
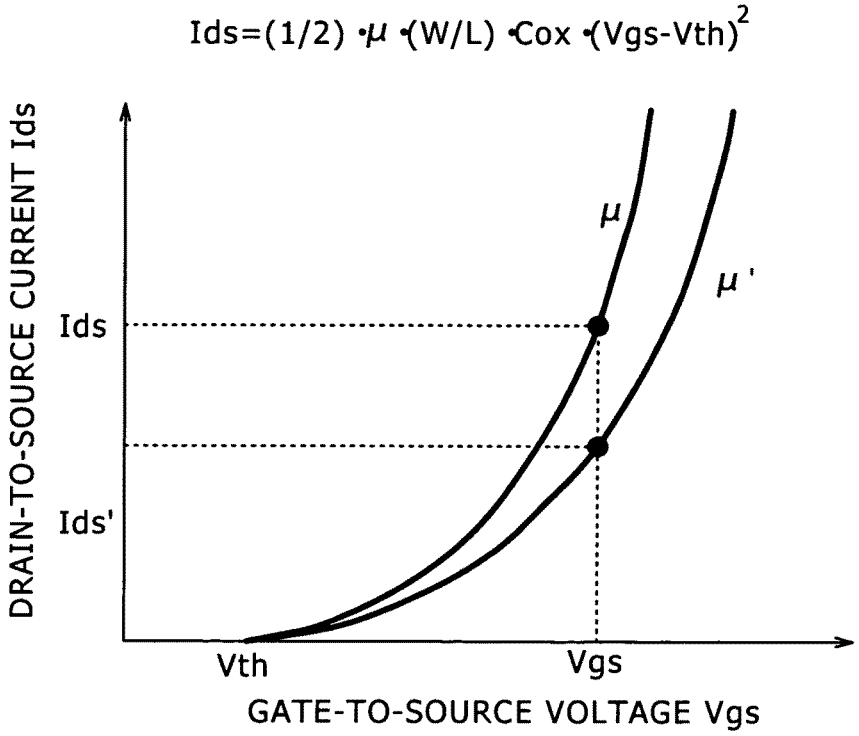
FIG. 6A is a graph showing current vs. voltage characteristics of different drive transistors.

FIG. 6A is also a graph showing current vs. voltage characteristics of different drive transistors. FIG. 6A shows respective characteristic curves of two drive transistors having different mobilities μ, μ'. As can be seen from the characteristic curves shown in FIG. 6A, if the drive transistors have different mobilities μ, μ', then they have different drain-to-source currents Ids, Ids' even when the gate voltage Vgs is constant.

Figure 6B:
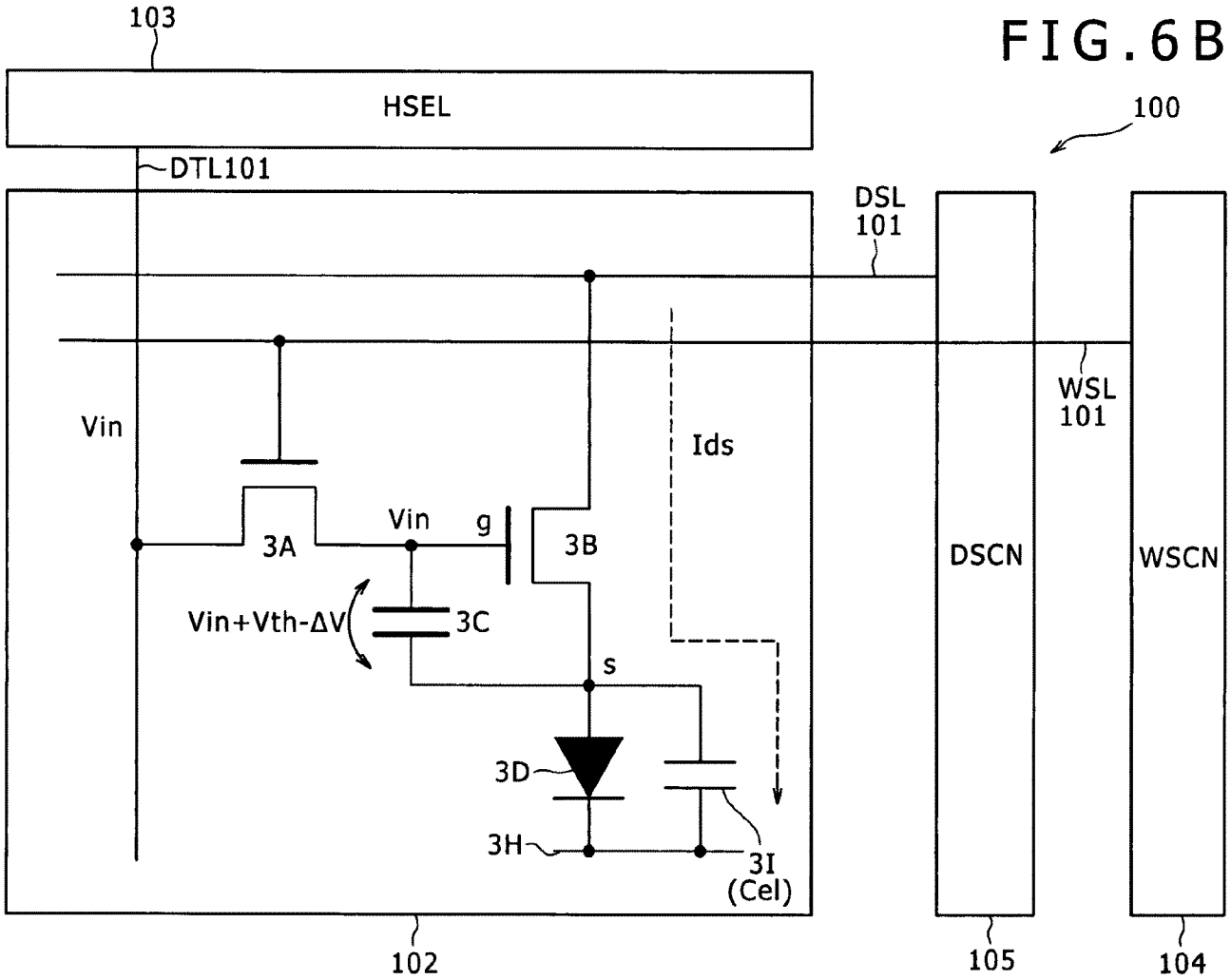
FIG. 6B is a circuit diagram illustrative of the manner in which the pixel circuit shown in FIG. 3B operates.

FIG. 6B is a circuit diagram illustrative of the manner in which the pixel circuit shown in FIG. 3B operates for sampling the video signal potential and correcting the mobility. For an easier understanding of the invention, FIG. 6B also illustrates the parasitic capacitance 3I of the light-emitting device 3D. For sampling the video signal potential Vin, the sampling transistor 3A is turned on. Therefore, the gate potential Vg of the drive transistor 3B is set to the video signal potential Vin, and the gate-to-source voltage Vgs of the drive transistor 3B reaches Vin+Vth. At this time, the drive transistor 3B is turned on. As the light-emitting device 3D is cut off, the drain-to-source current Ids flows into the light-emitting device capacitance 3I. When the drain-to-source current Ids flows into the light-emitting device capacitance 3I, the light-emitting device capacitance 3I starts being charged, causing the anode potential of the light-emitting device 3D (hence, the source potential Vs of the drive transistor 3B) to start increasing. When the source potential Vs of the drive transistor 3B increases by ΔV, the gate-to-source voltage Vgs of the drive transistor 3B decreases by ΔV. This process is referred to as the mobility correcting operation based on negative feedback. The reduced amount ΔV of the gate-to-source voltage Vgs is determined by $\Delta V=Ids\cdot Cel/t$ and serves as a parameter for the mobility correction, where Cel represents the capacitance value of the light-emitting device capacitance 3I and t represents the mobility correcting period, i.e., the period between the first timing and the second timing.

Figure 6C:
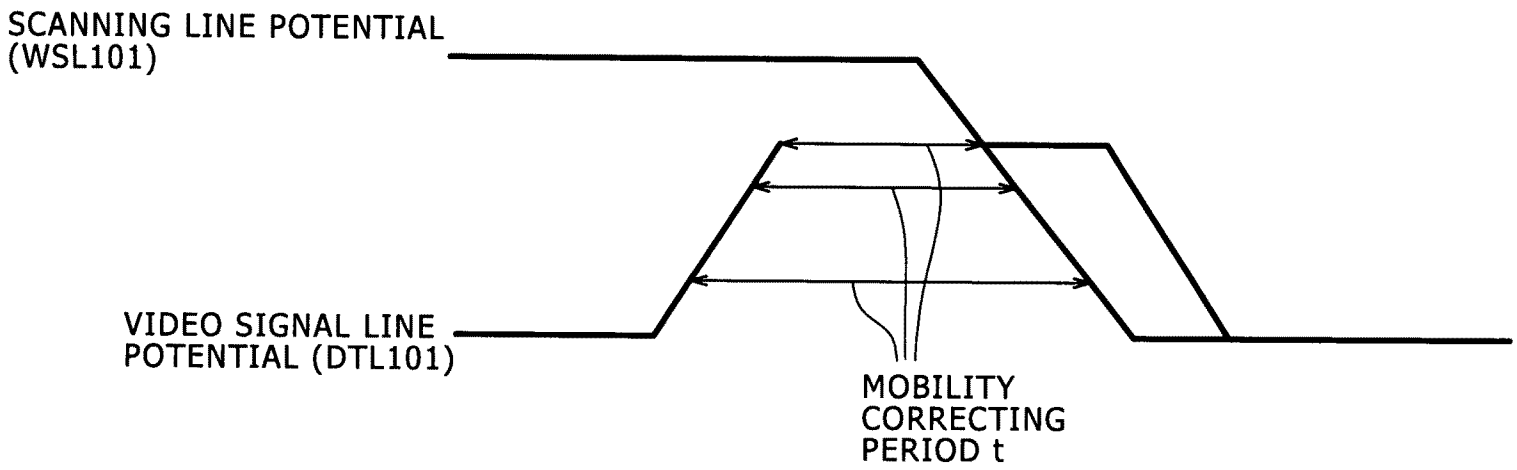
FIG. 6C is a waveform diagram illustrative of the manner in which the pixel circuit shown in FIG. 3B operates.

FIG. 6C shows an operation timing sequence of the pixel circuit for determining the mobility correcting period t. In the example shown in FIG. 6C, a gradient is applied to the positive-going edge of the video signal potential, thereby allowing the mobility correcting period t to automatically follow the video signal potential, so that the mobility correcting period t is optimized. As shown in FIG. 6C, the mobility correcting period t is determined by the phase difference between the scanning line WSL101 and the video signal line DTL101, and also by the potential of the video signal line DTL101. The mobility correcting parameter ΔV is represented by $\Delta V=Ids\cdot cel/t$. As can be seen from this equation, the mobility correcting parameter ΔV is greater as the drain-to-source current Ids of the drive transistor 3B is greater. Conversely, when the drain-to-source current Ids of the drive transistor 3B is smaller, the mobility correcting parameter ΔV is smaller. Therefore, the mobility correcting parameter ΔV is determined depending on the drain-to-source current Ids. The mobility correcting period t may not necessarily be constant, but preferably should be adjusted depending on Ids in some cases. For example, if Ids is greater, then the mobility correcting period t should be shorter, and if Ids is smaller, then the mobility correcting period t should be longer. In the example shown in FIG. 6C, a gradient is applied to at least the positive-going edge of the video signal potential to automatically adjust the mobility correcting period t such that the mobility correcting period t is shorter when the potential of the video signal line DTL101 is higher (Ids is greater) and the mobility correcting period t is longer when the potential of the video signal line DTL101 is lower (Ids is smaller).

Figure 6D:
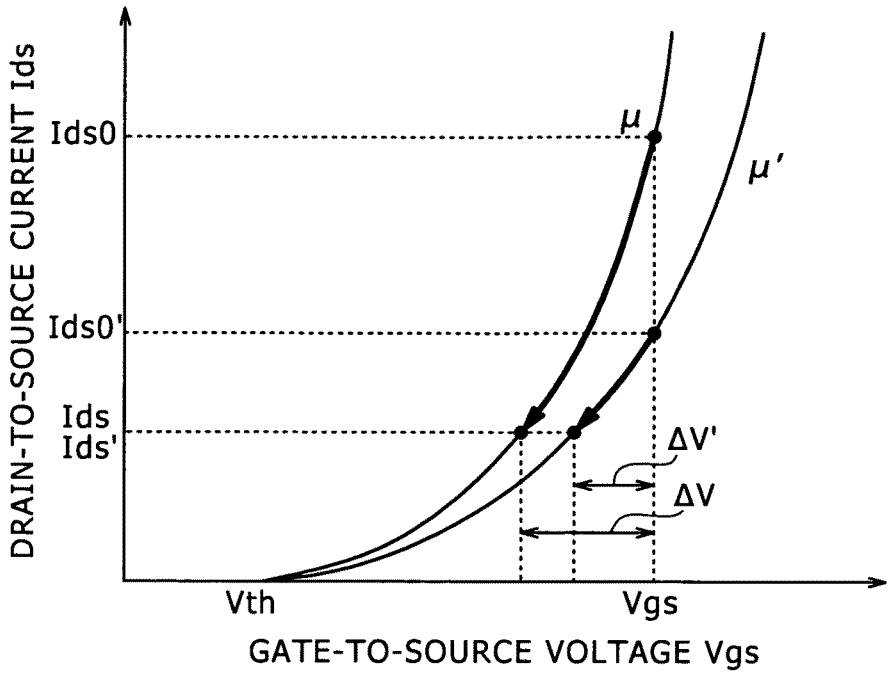
FIG. 6D is a graph showing current vs. voltage characteristics, which is illustrative of the manner in which the pixel circuit shown in FIG. 3B operates.

FIG. 6D is a graph illustrative of operating points of the drive transistor 3B at the time the mobility is corrected. When the above mobility correction is performed on the different mobilities μ, μ' due to the fabrication process, optimum correcting parameters ΔV, ΔV' are determined to determine drain-to-source currents Ids, Ids' of the drive transistor 3B. In the absence of the mobility correction, if the different mobilities μ, μ' are given with respect to the gate-to-source voltage Vgs, then correspondingly different drain-to-source currents Ids0, Ids0' are produced. To solve the above problem, appropriate correcting parameters ΔV, ΔV' are applied respectively to the different mobilities μ, μ' to determine drain-to-source currents Ids, Ids' at the same level. A review of the graph shown in FIG. 6D clearly indicates that negative feedback is applied to make the correcting variable ΔV greater when the mobility μ is greater and also to make correcting variable ΔV' smaller when the mobility μ' is smaller.

Figure 7A:
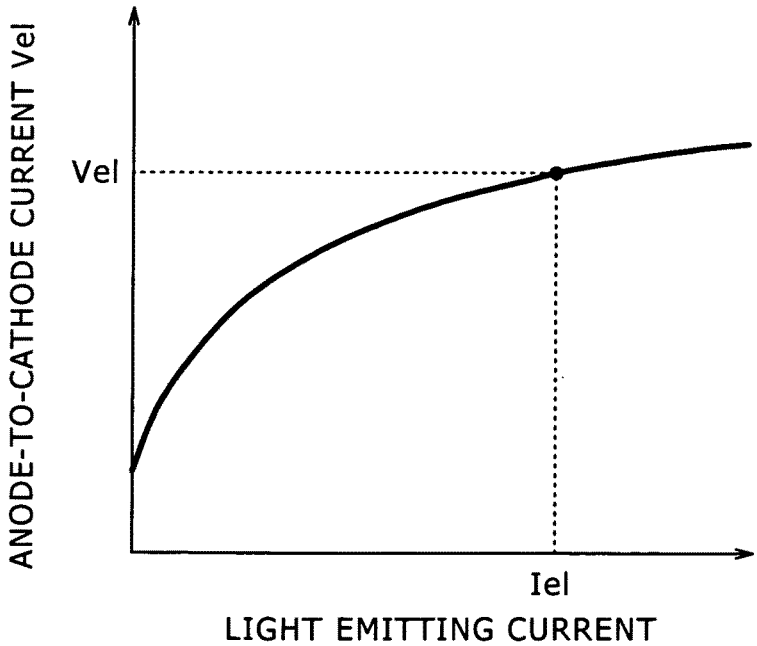
FIG. 7A is a graph showing current vs. voltage characteristics of a light-emitting device.

FIG. 7A is a graph showing current vs. voltage characteristics of the light-emitting device 3D which is in the form of an organic EL device. When a current Iel starts to flow into the light-emitting device 3D, the anode-to-cathode voltage Vel is uniquely determined. When the scanning line WSl101 goes to the low potential, turning off the sampling transistor 3A, as shown in FIG. 4G, the anode potential of the light-emitting device 3D increases by the anode-to-cathode voltage Vel that is determined by the drain-to-source current Ids of the drive transistor 3B.

Figure 7B:
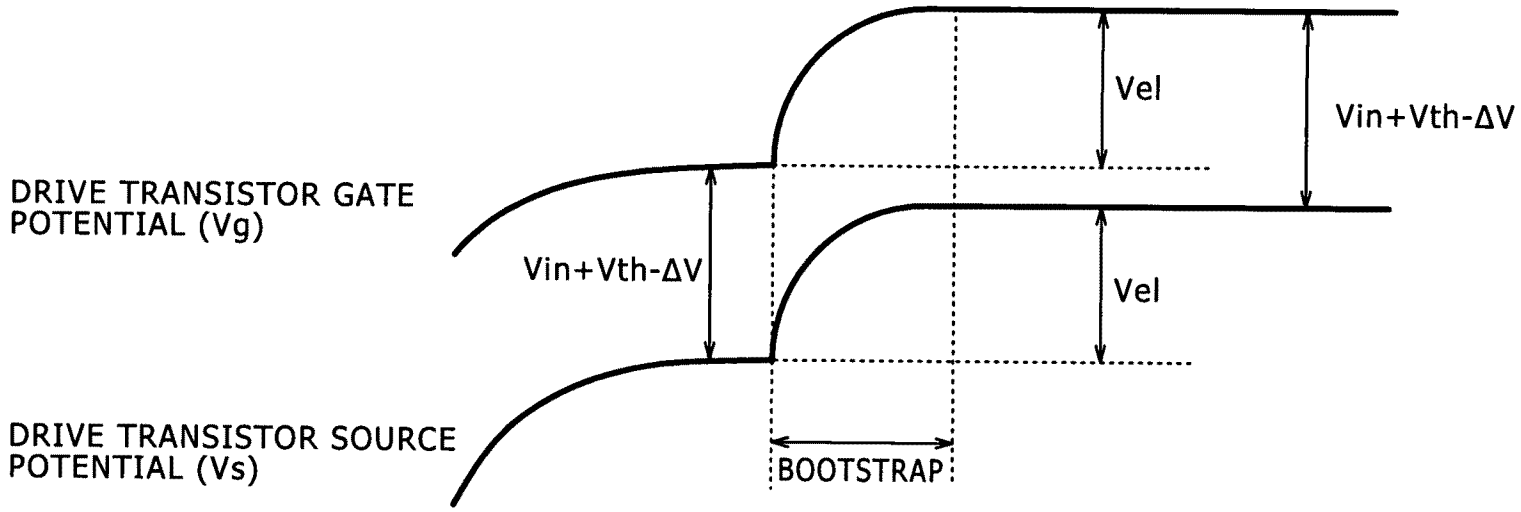
FIG. 7B is a waveform diagram showing a bootstrap operation of the drive transistor.

FIG. 7B is a graph showing potential variations of the gate potential Vg and the source potential Vs of the drive transistor 3B at the time the anode potential of the light-emitting device 3D increases. When the anode potential of the light-emitting device 3D increases by Vel, the source potential Vs of the drive transistor 3B also increases by Vel, and the gate potential Vg of the drive transistor 3B also increases by Vel due to the bootstrapping operation of the retention capacitor 3C. Therefore, the gate-to-source voltage Vgs=Vin+Vth−ΔV of the drive transistor 3, which is retained before the bootstrapping operation, also is retained after the bootstrapping operation. Even if the anode potential of the light-emitting device 3D varies due to aging of the light-emitting device 3D, the gate-to-source voltage of the drive transistor 3B is kept at the constant level of Vin+Vth−ΔV at all times.

Figure 7C:
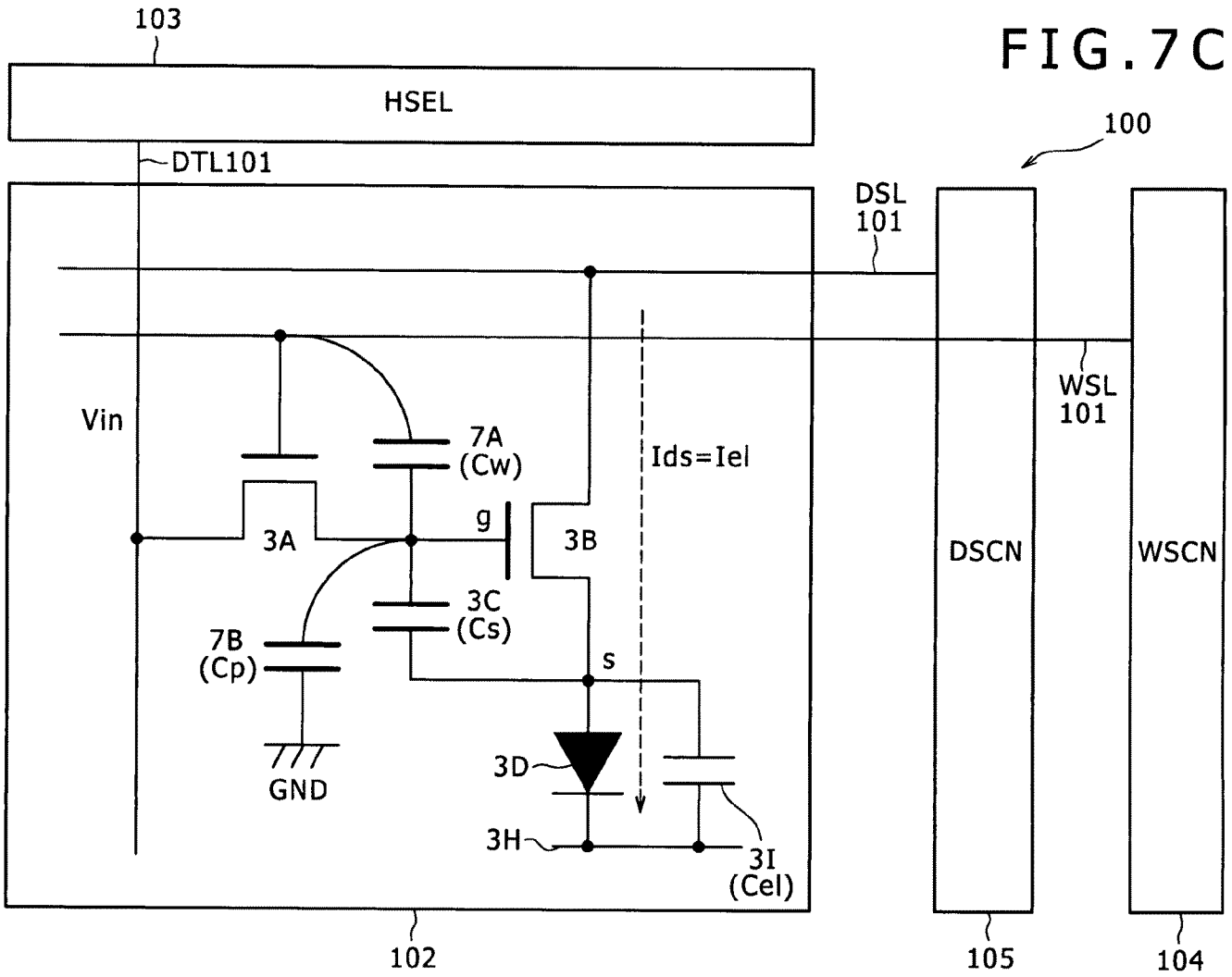
FIG. 7C is a circuit diagram illustrative of the manner in which the pixel circuit shown in FIG. 3B operates.

FIG. 7C is a circuit diagram of the pixel circuit shown in FIG. 3B, with parasitic capacitances 7A, 7B being illustrated. The parasitic capacitances 7A, 7B are parasitically added to the gate g of the drive transistor 3B. The bootstrapping operation capability referred to above is expressed by Cs/(Cs+Cw+Cp) where Cs represents the capacitance value of the retention capacitor 3C and Cw, Cp represents the respective capacitance values of the parasitic capacitances 7A, 7B. As Cs/(Cs+Cw+Cp) is closer to 1, the bootstrapping operation capability is higher, i.e., the correcting ability against the aging of the light-emitting device 3D is higher. According to an embodiment of the present invention, the number of devices connected to the gate g of the drive transistor 3B is held to a minimum. Therefore, the capacitance value Cp is negligible. The bootstrapping operation capability thus can be expressed by Cs/(Cs+Cw), which is infinitely close to 1, indicating that the correcting ability against the aging of the light-emitting device 3D is high.

Figure 8:
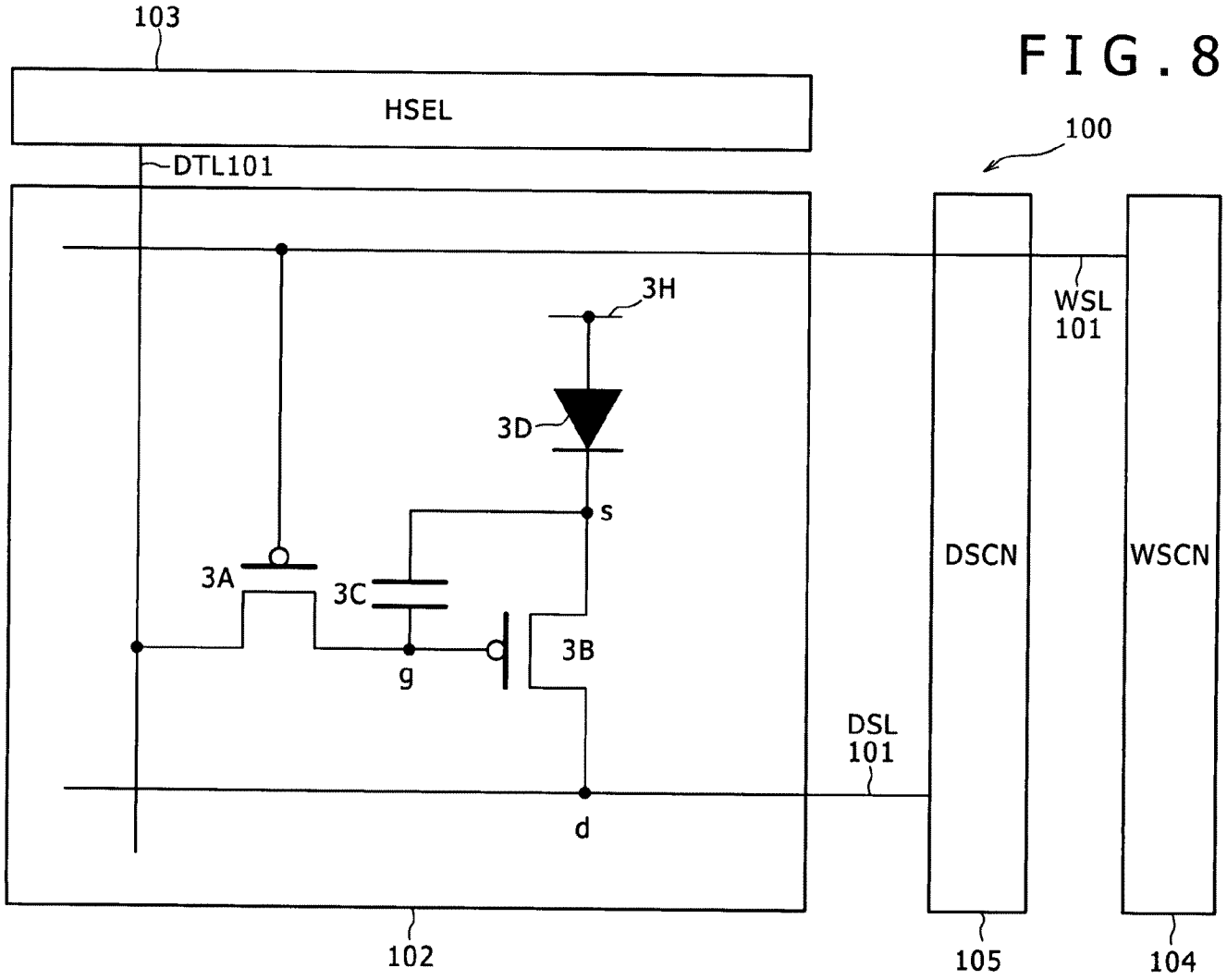
FIG. 8 is a circuit diagram of a pixel circuit of the display apparatus according to another embodiment of the present invention.

FIG. 8 is a circuit diagram of a pixel circuit of the display apparatus according to another embodiment of the present invention. For an easier understanding of the invention, those parts shown in FIG. 8 which correspond to those shown in FIG. 3B are denoted by corresponding reference characters. The pixel circuit shown in FIG. 8 is different from the pixel circuit shown in FIG. 3 in that whereas the pixel circuit shown in FIG. 3 employs N-type transistors, the pixel circuit shown in FIG. 8 employs P-type transistors. The pixel circuit shown in FIG. 8 is capable of performing the threshold voltage correcting operation, the mobility correcting operation, and the bootstrapping operation exactly in the same manner as with the pixel circuit shown in FIG. 3.

The display apparatus according to an embodiment of the present invention as described above can be used as a display apparatus for various electronic units, as shown in FIGS. 9A through 9G, including a digital camera, a notebook personal computer, a cellular phone unit, a video camera, etc., for displaying video signals generated in the electronic units as still images or video images.

The display apparatus according to an embodiment of the present invention may be of a module configuration as shown in FIG. 10, such as a display module having a pixel matrix applied to a transparent facing unit. The display module may include a color filter, a protective film, and a light blocking film, etc. disposed on the transparent facing unit. The display module also may have FPCs (Flexible Printed Circuits) for inputting signals to and outputting signals from the pixel matrix.

The electronic units as shown in FIGS. 9A through 9G will be described below.

FIG. 9A shows a television set having a video display screen 1 made up of a front panel 2, etc. The display apparatus according to an embodiment of the present invention is incorporated in the video display screen 1.

FIGS. 9B and 9C show a digital camera including an image capturing lens 1, a flash light-emitting unit 2, a display unit 3, etc. The display apparatus according to an embodiment of the present invention is incorporated in the display unit 3.

FIG. 9D shows a video camera including a main body 1, a display panel 2, etc. The display apparatus according to an embodiment of the present invention is incorporated in the display panel 2.

FIGS. 9E and 9F show a cellular phone unit including a display panel 1, an auxiliary display panel 2, etc. The display apparatus according to an embodiment of the present invention is incorporated in the display panel 1 and the auxiliary display panel 2.

FIG. 9G shows a notebook personal computer including a main body 1 having a keyboard 2 for entering characters, etc. and a display panel 3 for displaying images. The display apparatus according to an embodiment of the present invention is incorporated in the display panel 3.

Although certain preferred embodiments of the present invention have been shown and described in detail, it should be understood that various changes and modifications may be made therein without departing from the scope of the appended claims.

What is claimed is:

1. A display apparatus comprising:

a pixel array having scanning lines, signal lines, pixels forming a matrix, and power supply lines, a power supply scanner configured to supply a first potential and a second potential to said power supply lines, at least one of the pixels including a light-emitting device, a sampling transistor, a drive transistor, and a retention capacitor, the sampling transistor configured to sample a signal potential supplied from one of the signal lines and to retain the sampled signal potential in the retention capacitor, the drive transistor configured to supply a current from the power supply line at the first potential to the light-emitting device depending on the signal potential, wherein a potential of a corresponding one of said power supply lines is switched from the first potential to the second potential after the sampling transistor is rendered conductive at a beginning of a field period and a potential of the one of the signal lines is at a reference potential, wherein a potential of the one of the signal lines is switched from the reference potential to the signal potential at a first timing after the sampling transistor is rendered conductive and a potential of the corresponding power supply line is the first potential, wherein the sampling transistor is rendered nonconductive at a second timing occurring after the first timing while the potential of the one of the signal lines remains at the signal potential and the potential of the corresponding power supply line remains at the first potential, and wherein a period between the first timing and the second timing is appropriately set to correct the sampled signal potential as it is retained in the retention capacitor with respect to a mobility of the drive transistor.

2. The display apparatus according to claim 1, wherein a video signal is supplied as the signal potential through the one of the signal lines, and a relative phase difference between the video signal and a control signal is adjusted to optimize the period between the first timing and the second timing, the control signal being applied to the scanning line to render the sampling transistor conductive or nonconductive.

3. The display apparatus according to claim 1, wherein a video signal is supplied as the signal potential through the signal line, and a gradient is applied to a positive-going edge of the video signal that switches from the reference potential to the signal potential, which allows the period between the first timing and the second timing to automatically follow the signal potential.

4. The display apparatus according to claim 1, wherein when the sampled signal potential is retained by the retention capacitor, the sampling transistor is rendered nonconductive to electrically disconnect a gate of the drive transistor from the signal line, so that a gate potential of the drive transistor is linked to a variation of a source potential of the drive transistor to keep constant a voltage between the gate and a source of the drive transistor.

5. An electronic device including a display apparatus, the display apparatus comprising:

a pixel array having scanning lines, signal lines, pixels forming a matrix, and power supply lines, a power supply scanner configured to supply a first potential and a second potential to said power supply lines, at least one of the pixels including a light-emitting device, a sampling transistor, a drive transistor, and a retention capacitor, the sampling transistor configured to sample a signal potential supplied from one of the signal lines, and retain the sampled signal potential in the retention capacitor, the drive transistor configured to supply a current from the power supply line at the first potential to the light-emitting device depending on the signal potential, wherein a potential of a corresponding one of said power supply lines is switched from the first potential to the second potential after the sampling transistor is rendered conductive at a beginning of a field period and a potential of the one of the signal lines is at a reference potential, wherein a potential of the one of the signal lines is switched from the reference potential to the signal potential at a first timing after the sampling transistor is rendered conductive and a potential of the corresponding power supply line is the first potential, wherein the sampling transistor is rendered nonconductive at a second timing occurring after the first timing while the potential of the one of the signal lines remains at the signal potential and the potential of the corresponding power supply line remains at the first potential, and wherein a period between the first timing and the second timing is appropriately set to correct the sampled signal potential as it is retained in the retention capacitor with respect to a mobility of the drive transistor.

6. The electronic device according to claim 5, wherein a video signal is supplied as the signal potential through the signal line, and a relative phase difference between the video signal and a control signal that is applied to the scanning line to render the sampling transistor conductive or nonconductive is adjusted to optimize the period between the first timing and the second timing.

7. The electronic device according to claim 5, wherein a video signal is supplied as the signal potential through the signal line, and a gradient is applied to a positive-going edge of the video signal that switches from the reference potential to the signal potential, which allows the period between the first timing and the second timing to automatically follow the signal potential.

8. The electronic device according to claim 5, wherein when the sampled signal potential is retained by the retention capacitor, the sampling transistor is rendered nonconductive to electrically disconnect a gate of the drive transistor from the signal line, so that a gate potential of the drive transistor is linked to a variation of a source potential of the drive transistor to keep constant a voltage between the gate and a source of the drive transistor.

9. A display apparatus comprising:

a pixel array having scanning lines, signal lines, a matrix of pixels, and power supply lines, a power supply scanner configured to supply a first potential and a second potential to said power supply lines, at least one of the pixels including a light-emitting device, a sampling transistor, a drive transistor, and a retention capacitor, the sampling transistor configured to sample a signal potential supplied from the signal line, and retain the sampled signal potential in the retention capacitor, the drive transistor configured to supply a current from the power supply line at the first potential to the light-emitting device depending on the signal potential, wherein a potential of a corresponding one of said power supply lines is switched from the first potential to the second potential after the sampling transistor is rendered conductive at a beginning of a field period and a potential of the one of the signal lines is at a reference potential, wherein a potential of the one of the signal lines is switched from the reference potential to the signal potential at a first timing after the sampling transistor is rendered conductive and a potential of the corresponding power supply line is the first potential, wherein the sampling transistor is rendered nonconductive at a second timing occurring after the first timing while the potential of the one of the signal lines remains at the signal potential and the potential of the corresponding power supply line remains at the first potential, and wherein a gate-to-source voltage of the drive transistor is configured to decrease based on a negative feedback which is applied to make a correcting variable greater when a mobility of the drive transistor is greater and also to make the correcting variable smaller when the mobility is smaller.

10. The display apparatus according to claim 9, wherein a period between the first timing and the second timing is appropriately set to correct the sampled signal potential as it is retained in the retention capacitor with respect to the mobility of the drive transistor.

* * * * *